United States Patent [19]

Blumenthal et al.

[11] 3,957,507

[45] May 18, 1976

[54] OXIDATION RESISTANT REFRACTORY ALLOYS

[75] Inventors: Jack L. Blumenthal, Los Angeles; John R. Ogren, La Palma; Marvin Appel, Redondo Beach, all of Calif.

[73] Assignee: TRW Inc., Redondo Beach, Calif.

[22] Filed: June 14, 1972

[21] Appl. No.: 262,767

Related U.S. Application Data

[62] Division of Ser. No. 29,893, April 20, 1970, Pat. No. 3,713,901.

[52] U.S. Cl. ..... 75/134 N; 75/134 V; 75/177

[51] Int. Cl. ..... C22c 15/00; C22c 27/00

[58] Field of Search ..... 75/134 V, 134 N, 177

[56] References Cited

UNITED STATES PATENTS 3,622,308 11/1971 Hill et al. ..... 75/134 V

*Primary Examiner*—L. Dewayne Rutledge
*Assistant Examiner*—E. L. Weise
*Attorney, Agent, or Firm*—Willie Krawitz; Daniel T. Anderson; Alan D. Akers

[57] ABSTRACT

This invention relates to high-temperature, oxidation-resistant refractory materials or alloys and to a method of preparing said alloys which have an outer skin containing at least one noble metal, e.g., platinum, and/or silver, in amounts greater than the amount of noble metal present in the alloy beneath said skin. The alloy comprises at least one noble metal selected from the group consisting of platinum, gold, silver, rhodium, iridium and palladium. The noble metal is added in amounts ranging from 0.1 to 15% by weight of the total composition to hafnium or to hafnium containing from about 0 to 50% by weight of zirconium, and heated to temperatures ranging from about 1000°F to 3800°F in an oxidizing atmosphere.

5 Claims, 5 Drawing Figures

Figure 1:
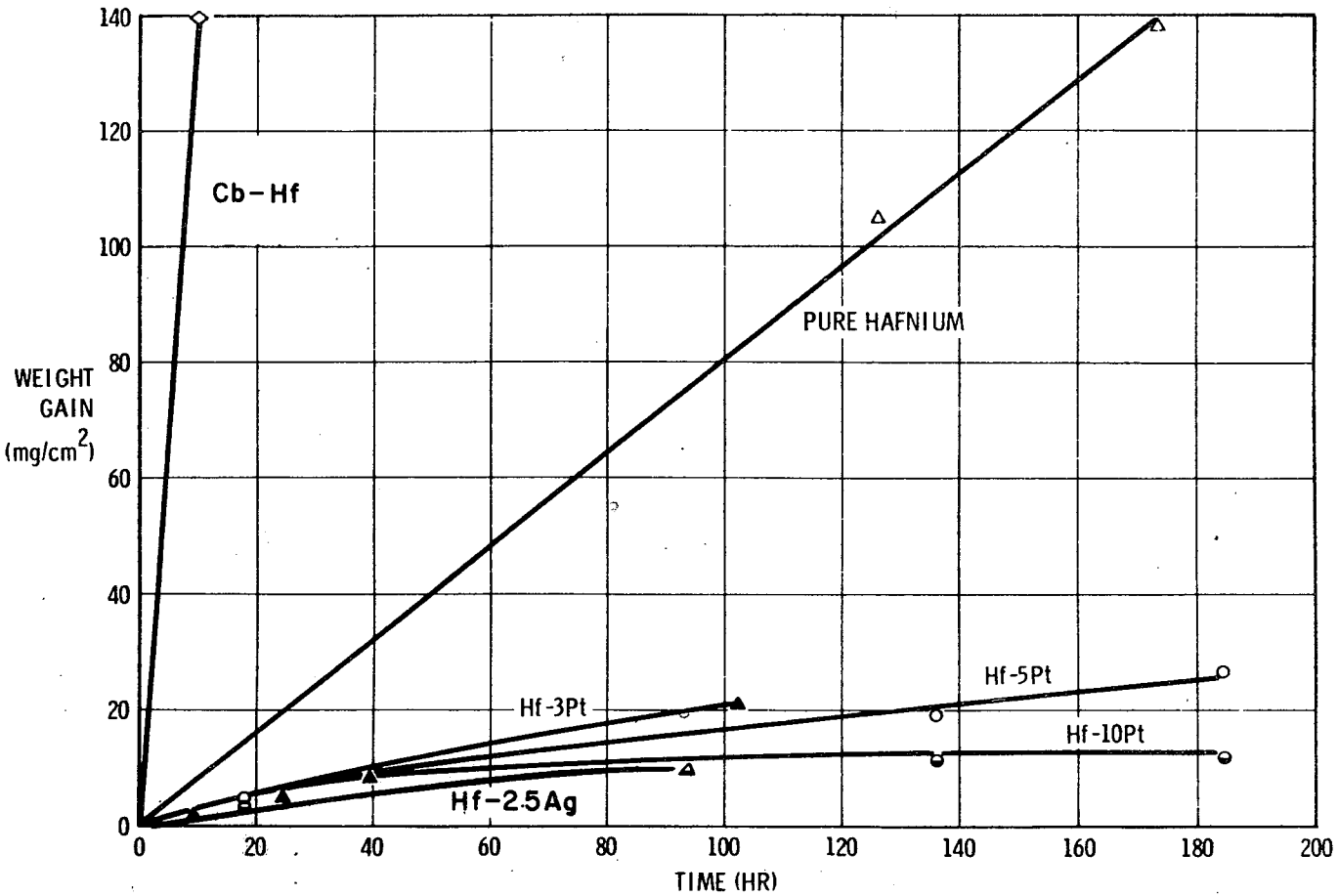

Comparison of the Air Oxidation of Hf Alloys with Pure Hafnium and Cb-Hf Alloy at 1500°F Air Oxidation of Alloys at 2200° F Short Term Air Oxidation of Hf-10Pt Alloys Room Temperature Stress-Strain Curve for One Hf-5%Pt Sample

OXIDATION RESISTANT REFRACTORY ALLOYS

This is a division of application Ser. No. 29,893 filed Apr. 20, 1970 now U.S. Pat. No. 3,713,901 dated Jan. 30, 1973.

This invention is directed to high-temperature, oxidation-resistant refractory materials or alloys and to the method of preparing said alloys which have outer skins containing at least one noble metal in an amount greater than the amount of noble metal present in the metal beneath the skin. More specifically, this invention is related to high-temperature oxidation-resistant refractory alloys having an outer metallic skin characterized as being rich in noble metal and highly resistant to oxidation at high temperatures. The refractory alloys on which said skin is formed, by subjecting the metal to temperatures ranging from 1000°F to 3800°F in an oxidizing atmosphere, consists essentially of hafnium, 0–50% by weight of zirconium, and 0.1 to 15% by weight of at least one noble metal. More specifically, this invention relates to high-temperature oxidation-resistant refractory alloys consisting essentially of a large amount of hafnium with smaller amounts of zirconium and one or more of a particular noble metal.

It has been found that alloys prepared by the addition of comparatively small amounts of a particular noble metal, e.g., platinum, silver, etc., to hafnium or hafnium in combination with zirconium results in alloys having a remarkable degree of oxidation-resistance at temperatures ranging up to about 3800°F. These alloys form an extremely tough, hard, thermal shock-resistant hafnium-noble metal intermetallic skin which inhibits oxidation and prevents oxidation contamination of the base hafnium-metal alloy. The alloys of this invention are a response to an urgent need for a refractory metal which possesses, in addition to a high melting point, a high degree of oxidation resistance at elevated temperatures where the mechanical properties of a metal must be outstanding. Heretofore, no metal has completely satisfied all of these requirements, although a number of the commercial high-temperature alloys have been developed with good mechanical properties. With the present interest in space vehicles, high-speed rocketry, etc., there is need for oxidation-resistant materials capable of exhibiting good mechanical properties at extremely high temperatures.

Presently, to avoid oxidation of the metal, it has been necessary to employ various materials, e.g., silicides, borides, aluminides, etc., as coatings when the metal is to be used at a high temperature in an oxidizing environment. While these metals were satisfactory in some respects, they were found to have many disadvantages, however, including, for example, a low resistance to thermal shock, difficulty in fabrication, relatively high cost, etc. Thus, in comparison, the alloys of this invention possess a remarkable degree of oxidation resistance in air over a broad temperature range up to about 3800°F. Moreover, these alloys do not exhibit a pest problem at the intermediate temperatures and are not susceptible to internal oxidation in a manner common to many of the refractory metal alloys known heretofore. The alloys of this invention are considered refractory due to their high melting points, e.g., 3000° to 4000°F which depend on the particular composition of the alloy. In comparison, most refractory alloys oxidize rapidly in air at the high temperatures even though their mechanical properties are adequate for the use intended. These problems have been recognized for years as an obstacle to the use, for example, of high-strength refractory alloys, e.g., Cb, Ta, W, and Mo base alloys in an oxidizing environment, and therefore this has been the subject of extensive research. None of the approaches, however, in solving the problem have been completely satisfactory in that they have failed to provide a refractory metal which can be used as a high-strength material in turbines, for example, at temperatures exceeding 1800°F.

Accordingly, it is an object of this invention to provide a high-temperature oxidation-resistant refractory alloy consisting essentially of hafnium, or hafnium and zirconium, with a lesser amount of at least one noble metal.

It is another object of this invention to provide a refractory alloy having an outer metallic skin which is resistant to oxidation at high temperatures which may be characterized as containing at least one noble metal in an amount greater than the amount of noble metal present in the alloy beneath said skin.

It is still another object of this invention to provide a process for preparing a refractory alloy having an outer metallic skin which is resistant to oxidation at comparatively high temperatures by reason of containing a comparatively large amount of noble metal.

It is still a further object of this invention to provide a method of preparing oxidation-resistant refractory alloys having good mechanical properties by homogenizing a small amount of at least one noble metal with hafnium or with a combination of hafnium and zirconium.

It is still a further object of this invention to provide an alloy and the process of preparing same which is characterized as being highly resistant to oxidation and thermal shock.

These and other objects of the invention will become apparent from a further and more detailed description as follows:

It has been found that by the addition of a comparatively small amount of at least one noble metal to hafnium or to a combination of hafnium and zirconium, an alloy can be obtained which has a remarkable degree of oxidation-resistance at temperatures ranging up to about 3800°. During the heating process, in an oxidizing atmosphere, the alloys of this invention form an extremely tough, hard, thermal shock-resistant hafnium-noble metal skin which inhibits further oxidation and prevents contamination of the base metal alloy. One of the outstanding features of the alloys of this invention is the formation at high temperatures in an oxidizing environment of a noble metal-rich metallic skin on the base metal at the interface between the alloy and the oxide scale. While it is not certain, it is believed that this metallic skin is highly resistant to oxidation and, therefore, provides a protective coating to the bulk of the alloy. This skin, however, should not be confused with the subsurface oxide stringers which are known to form in many of the alloys, nor with the fully dense subscale oxides that form in the superalloy class of materials. Instead, it is believed that the metallic skin or film formed on the alloys of this invention is truly within the metal and therefore is a characteristic which has been desired in order to achieve a high temperature oxidation-resistant refractory metal.

More specifically, the refractory alloys of this invention may be characterized as having an outer metallic skin resistant to oxidation at high temperatures which contains at least one noble metal in an amount greater than the noble metal present in the metal beneath the skin. The skin is formed by subjecting the alloy to temperatures ranging from about 1000°F to 3800°F in an oxidizing environment for periods of time, ranging from about 1/60 to 60 hours or more. The temperatures at which the alloys are heated generally range from about 1000°F to 3800°F and preferably from 1500°F to 3000°F, depending upon the length of time the particular alloy is heated, e.g., at least for one minute. As the temperature increases up to about 3800°F the length of time at which the alloy is heated in the oxidizing atmosphere, considering the composition of the particular alloy, will vary, but in any event will decrease as the temperature increases. Thus, for example, as the temperature ranges up to about 3800°F the period of time for which the alloys are heated in the oxidizing environment will decrease to about one minute or less, depending upon the composition of the particular alloy.

The alloys on which the metallic skin, rich in noble metal, is formed consists essentially of hafnium or a combination of hafnium and zirconium with 0.1 to 15% by weight of the total composition of at least one noble metal. Thus, the alloys of this invention consist essentially of 35 to 99.9% by weight of hafnium, 0 – 50% by weight of zirconium, and 0.1 to 15% and preferably 0.5 to 10% by weight of at least one noble metal selected from the group consisting of platinum, gold, silver, rhodium, iridium, palladium, and mixtures of two or more in any proportion, e.g., 0 to 100%.

The refractory alloys of this invention, in addition to a combination of hafnium and a noble metal comprise a combination of hafnium in amounts ranging from 35% to 95% by weight and preferably in amounts ranging from 50% to 85% by weight with 5.0% to 50% and preferably 5.0% to 30% by weight of zirconium. To these alloys or combinations of hafnium and zirconium one or more of the noble metals may be added in an amount ranging from 0.1 to 15% and preferably in an amount ranging from about 0.5 to 10% and still more preferably in an amount ranging from 1.0 to 6.0% by weight of the alloy. The noble metals are selected from the group consisting of platinum, gold, silver, rhodium, iridium, and palladium which may be used alone or in any combination thereof in various proportions. Thus, for example, for purposes of this invention, it is necessary to use at least one noble metal, and preferably at least two. However, in some instances three or more of said noble metals may be used in combination in any proportion, e.g., 0 to 100% respectively, of the total noble metal fraction. Thus, the total amount of noble metal or metals added to hafnium or to a hafnium-zirconium composition may range from 0.1 to 15% by weight of the total alloy.

Air oxidation studies with several hafnium-noble metal alloys were conducted over a broad temperature range from about 1000°F to 3800°F by utilizing test specimens nominally 10 grams in weight. The oxidation rate data were determined by weighing the samples before and after thermal exposure and since there was no evidence of oxide spalling with the alloy, the weight gain data (mg/cm$^2$) represents a true measure of the extent of oxidation. Each time a datum point was obtained, the test samples were exposed to severe thermal shock, since they were pulled directly and quickly from the oxidation furnace into ambient air. A comparison of the post-test microscopic examination of sectioned specimens with the measured weight gain indicated that a weight gain of approximately 6 mg/cm$^2$ was equivalent to one mil of metal recession. An examination of the specimens indicated that there was no evidence of internal alloy oxidation beyond the surface oxide scale.

FIG. 1 presents a plot of weight gain versus time for several of the alloys and compares the results with pure hafnium and a commercial Cb-Hf alloy. The data were taken at the intermediate temperature of 1500°F. Under these conditions it is apparent that the hafnium-platinum alloys and the Hf-Ag alloy oxidize slowly and protectively wherein the rate of oxidation decreased within increasing time and that the addition of small amounts of platinum or silver, for example, to hafnium, e.g., 2.5% by weight of silver dramatically decreases the hafnium oxidation rate. On the other hand, the Cb-Hf alloy oxidizes catastrophically under these same conditions. Although the Cb-Hf alloy has a remarkable measure of oxidation-resistance in the ranges from room temperature to 1100°F and from 1800°F to 2200°F, its behavior in the intermediate temperature range (pest problem) is typical of many oxidation-resistant columbium and hafnium-based alloys. Thus, it is noteworthy that the hafnium-noble metal alloys showed no evidence of a pest problem at the intermediate temperatures and therefore their potential for practical application is greatly enhanced.

Figure 2:
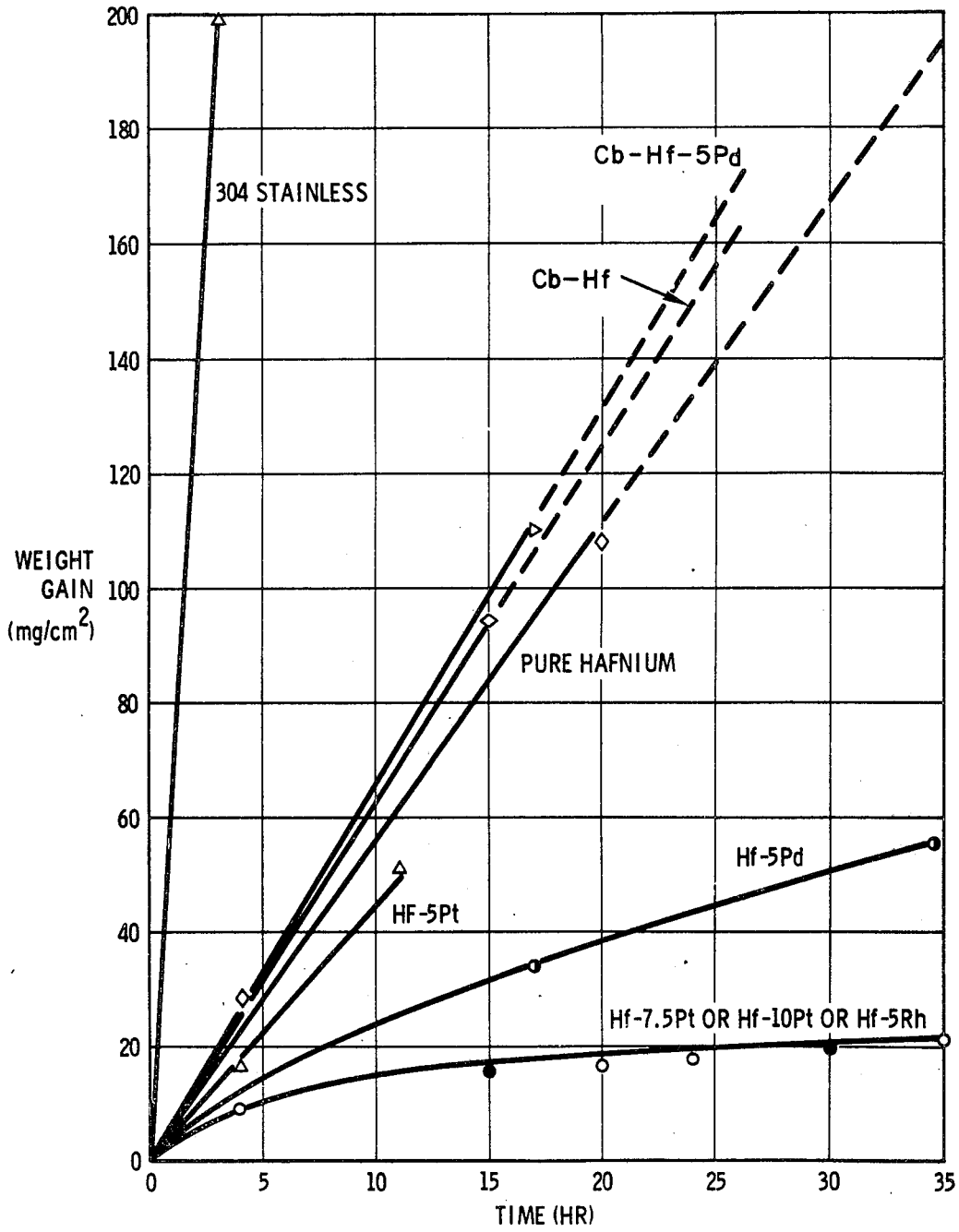

FIG. 2 represents oxidation data (weight gain versus time) for several hafnium-noble metal alloys at 2200°F and compares the results with pure hafnium and other commercial alloys. As indicated, the most oxidation-resistant combinations tested included hafnium containing 10% by weight of platinum, hafnium containing 7.5% by weight of platinum, and hafnium containing 5% by weight of rhodium.

Figure 3:
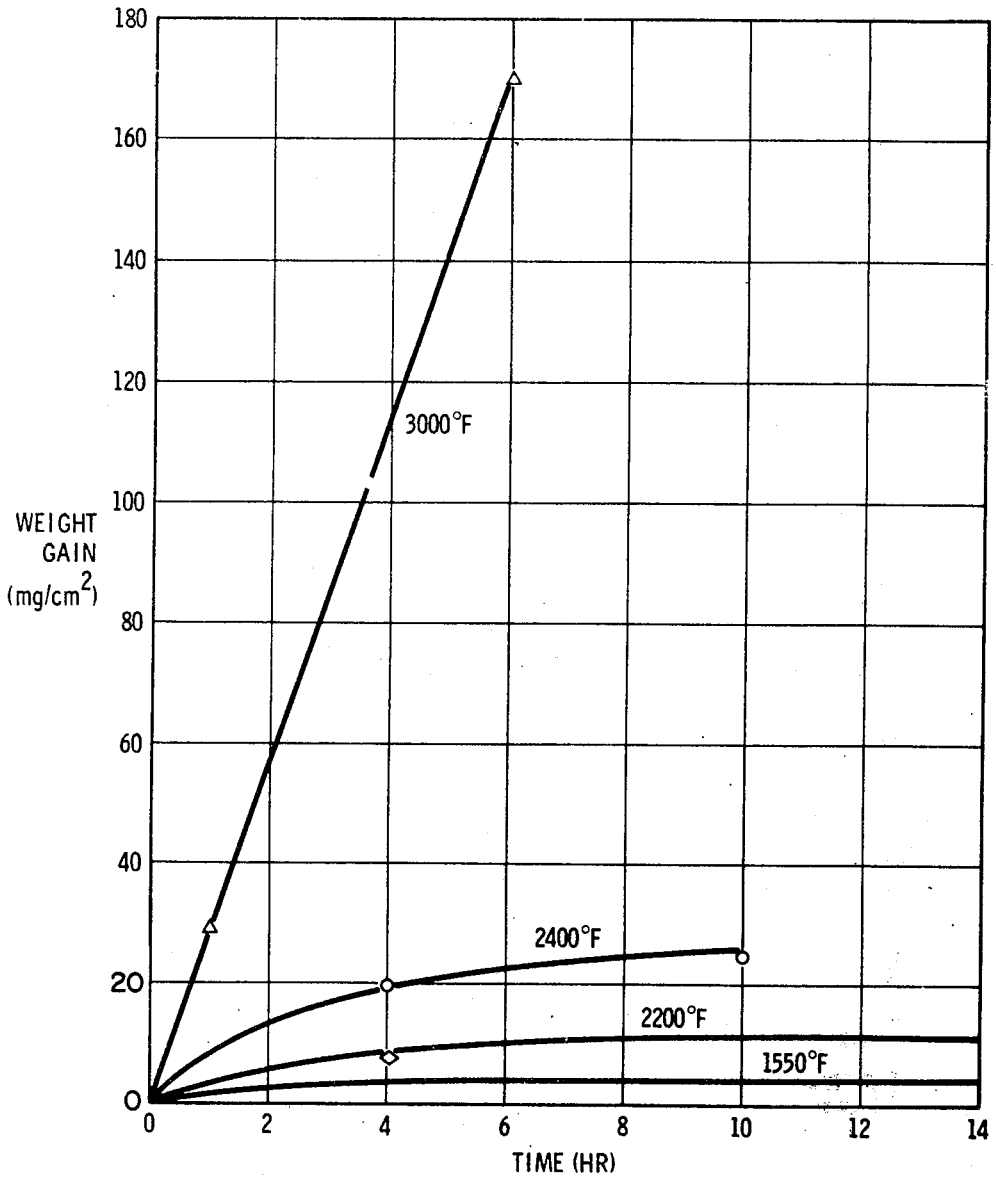

FIG. 3 shows oxidation data for hafnium containing 10% by weight of platinum at several temperatures ranging from 1550°F to 3000°F. Relatively slow, protective oxidation kinetics were obtained at least up to temperatures of 2400°F. At 3000°F, it should be noted that the rate of oxidation of the alloy, although linear, was very much lower than the rates of oxidation of other refractory alloys.

Figure 4:
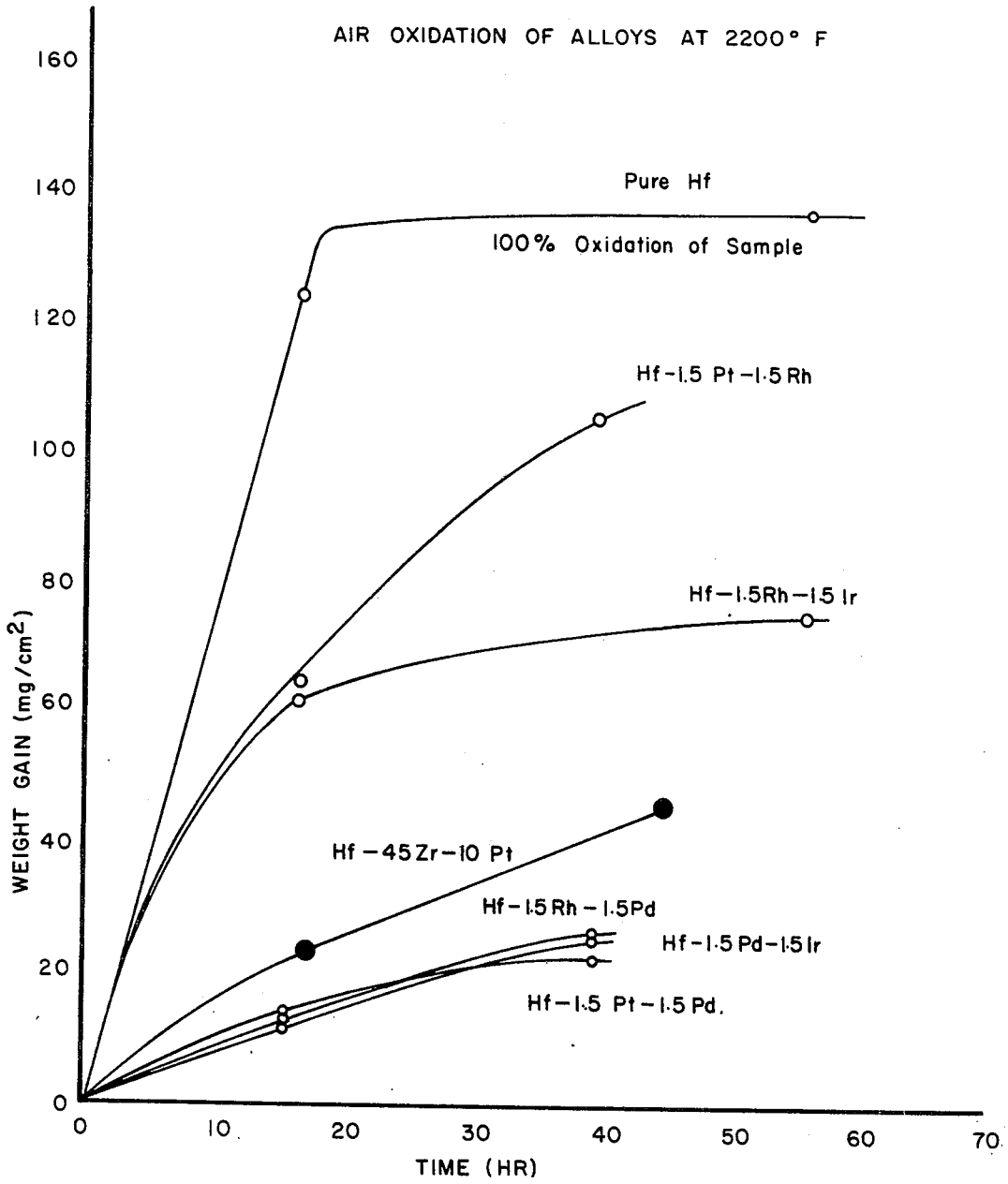

FIG. 4 presents oxidation data (weight gain versus time) for several hafnium-zirconium noble metal alloys of this invention at a temperature of 2200°F. As indicated, the oxidation-resistant combination of an alloy of hafnium containing 45% by weight of zirconium and 10% by weight of platinum was substantially superior to hafnium alone and that hafnium containing one or more noble metals in various proportions was also substantially superior to pure hafnium. Thus, it has been illustrated that the oxidation-resistance of the alloys of this invention exist throughout the temperature range from room temperature to about 3800°F.

A photomacrograph of a sectioned hafnium-platinum specimen after 60 hours of exposure in air at a temperature of 2200°F shows an extremely tough, adherent, thermal-shock resistant hafnium oxide-platinum cermet scale formed on the outside of the specimen. For every mil of metal recession which took place during oxidation, approximately 1.3 mils of the cermet structure formed. It it believed that a noble metal-rich metallic skin which forms under the cermet layer is the major source of oxidation protection. This skin grows in situ with increasing time and temperature in an oxidizing environment and it is theorized that the oxidation kinetics are controlled by the rate of hafnium diffusion through the metallic skin.

A higher magnification image of the interface between the alloy and the oxide scale indicates a platinum-rich metallic film (0.001 inch in thickness) at a location between the nonoxidized alloy and the oxide. This alloy is a hafnium-10% platinum alloy that was oxidized for 60 hours at 2200°F. There were no signs even at a 400X magnification of delamination between the base alloy and the oxide scale. Several individual areas of the Hf-10% Pt alloy have been identified by the combined use of X-ray diffraction analysis and electron microprobe analysis. The results of the studies showed that the continuous phase of the non-oxidized material is alpha hafnium, the hexagonal-close-packed terminal solid solution. This continuous phase contains less than 1% platinum as determined by quantitative electron-microprobe analysis. The discrete or discontinous phase in the non-oxidized material is a face-centered cubic intermetallic compound, $Hf_2Pt$. This phase contains 35% platinum and was identified by X-ray diffraction and the known crystallographic data for $Hf_2Pt$.

The innermost portion of the metallic film is also the compound $Hf_2Pt$. This conclusion is based on the observation that this portion of the film is optically continuous with the discrete phase in the nonoxidized alloy. The conclusion is supported by the observation that when the electron microprobe analyzer beam was scanned across the sample, both the hafnium and platinum intensities in the film were found to be comparable to those in larger particles of the discrete phase. The outermost portion of the film that is in contact with the oxide, is indicated to be a complex intermetallic compound, HfPt, by means of quantitative electron-microprobe analysis.

The formation of a noble-metal rich film is not a common phenomenon with refractory noble metal alloys in general, but has been found to exist also in hafnium containing 5% by weight of palladium and in hafnium containing 2.5% silver.

Figure 5:
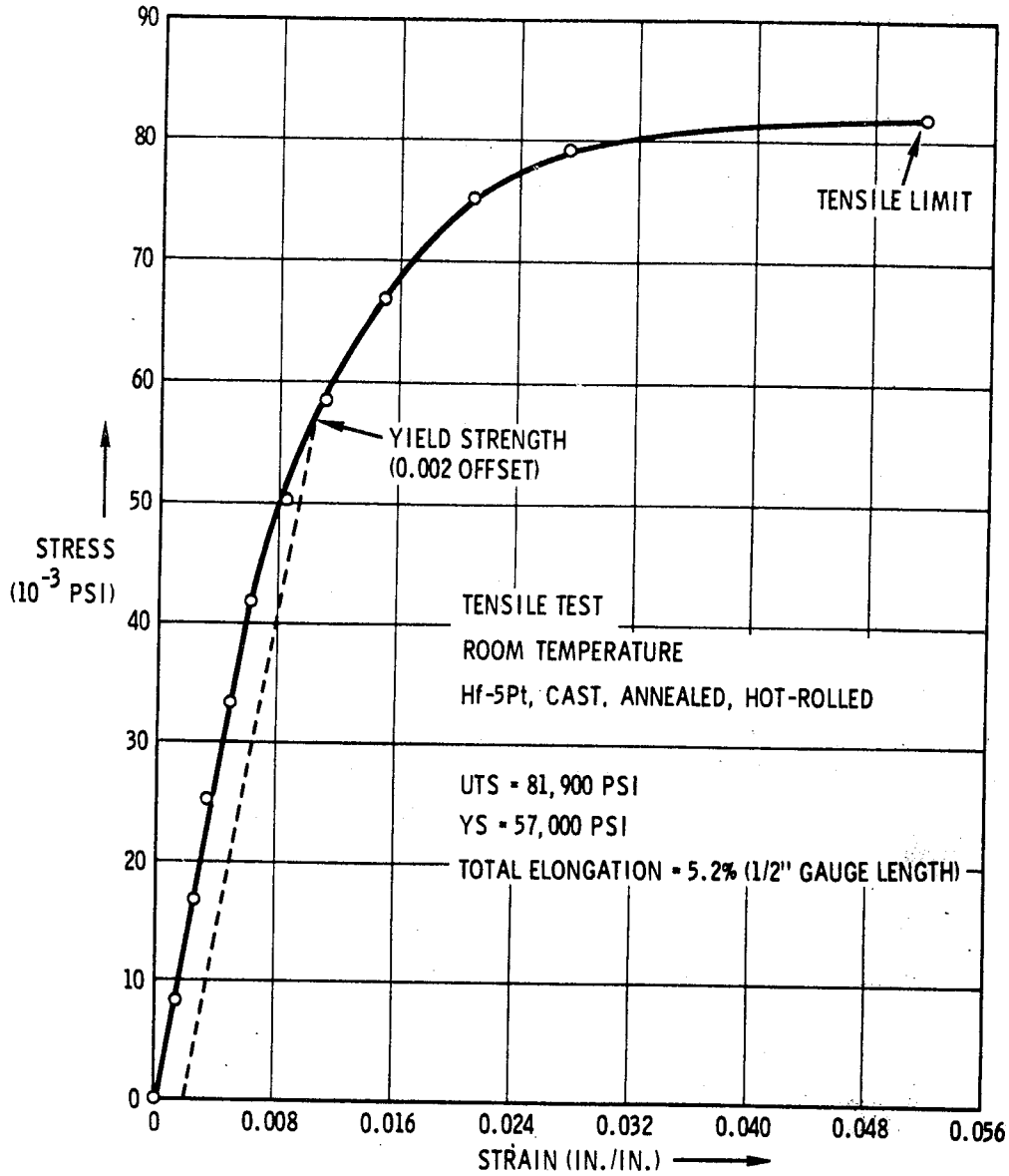

The mechanical properties of the alloys of this invention were evaluated by utilizing a hafnium-5% platinum alloy in two experiments. First, a 50 gram button was arc-cast and annealed for 48 hours at 2200°F in vacuum and then hot rolled at 1800°F in air into a plate, 0.092 inch in thickness. Second, a small-scale tensile specimen was machined from the 0.092 inch plate and was subjected to a room-temperature tensile test. FIG. 5 contains the stress-strain curve for this particular sample.

Table 1 contains comparative data for the alloys of this invention in comparison to known tantalum base alloys and noble metal alloys. It should be noted that at room temperature the ultimate tensile strength is 81,900 psi at an elongation of 5% for the hafnium-5% platinum alloy. The sample is therefore about 30% stronger than pure hafnium, which has an ultimate tensile strength of 62,000 psi.

As a supplement to the stress-strain curve, a series of microhardness measurements was conducted on samples at numerous stages of fabrication, oxidation, and welding. The microhardness data are summarized in Table 2 for a hafnium-5% Pt alloy.

TABLE 1

COMPARATIVE PROPERTIES

| | Hf-Pt Alloy | Pt-20Rh | Ta-10W | Ta-8W-2Hf |
|---|---|---|---|---|
| Density (p) (Lb/In³) | 0.485 | 0.678 | 0.607 | 0.610 |
| Yield Strength (psi) | 57,000 | 15,000 | 65,000–95,000 | 65,000–85,000 |
| Ultimate Tensile Strength (psi) | 81,900 | 55,000 | 75,000–105,000 | 80,000–110,000 |
| Specific Strength (Ksi/Lb/In) | 155 | 80 | 124–172 | 130–180 |
| Elongation | 5% (0.5") | 30% (2") | 15% (0.5") | 20% (1.0") |
| Melting Temperature °F | 3500–4000 | 3400 | 5500 | 5500 |
| Hardness (KHN) (Knoop Hardness Number) | 240–340 | 143 | 280 Max | 280 Max |

TABLE 2

MICROHARDNESS DATA FOR A Hf-5%Pt ALLOY

| | Knoop Hardness Number (KHN) | Rockwell (Equivalent) |
|---|---|---|
| As-Cast | 332 | $R_c$33 |
| Annealed 48 Hours 2200°F Vacuum | 270 | $R_c$24 |
| Oxidized 150 Hours 1550°F Air, Interior of Sample | 241 | $R_B$98 ($R_c$18) |
| Weld Zone | 342 | $R_c$34 |
| Wrought Zone | 320 | $R_c$31 |

It should be noted from the data in Table 2 that the Knoop hardness of the as-cast materials is 332 which exceeds that of most standard stainless steels and is equal to that of a precipitation-hardened stainless steel. The hardness of the alloy decreased upon exposure to a vacuum anneal at 2200°F. This reduction is due to the relaxation of the thermal stresses which had been introduced into the sample during the rapid cooling which is associated with the initial arc-casting operation. The oxidized sample was slightly softer than the as-cast material at all locations within the interior of the sample, i.e., interior with respect to the metallic film. This result strongly suggests that no internal oxidation has taken place within the interior of the sample because, if it had, an increase rather than a decrease in hardness would have been detected. Moreover, the welded zone of the hafnium-5% platinum sample had virtually the same hardness as the as-cast material, which means that the weld nugget was not contaminated during the welding operation. This suggests that the hafnium alloys of this invention are readily weldable.

While this invention has been described with respect to a number of specific embodiments, it is obvious that there are other variations and modifications which can be made without departing from the spirit and scope of the invention as particularly pointed out in the appended claims.

What is claimed is:

1. A high-temperature oxidation-resistant refractory alloy consisting essentially of 35 – 95% by weight of hafnium, 5.0 to 50% by weight of zirconium and 0.1 to 15% by weight of at least one noble metal selected from the group consisting of platinum, gold, silver, rhodium, iridium, and palladium.

2. The refractory alloy of claim 1 further characterized as consisting essentially of 50 – 85% by weight of hafnium, 5.0 to 50% by weight of zirconium and 0.5 to 10% by weight of at least one of the noble metals.

3. The refractory alloy of claim 2 further characterized as containing at least two noble metals.

4. A refractory alloy of claim 2 further characterized in that at least one of the noble metals is platinum.

5. A refractory alloy of claim 2 further characterized in that at least one of the noble metals is silver.

* * * * *